US009892702B2

(12) United States Patent
Lin et al.

(10) Patent No.: US 9,892,702 B2
(45) Date of Patent: Feb. 13, 2018

(54) PIXEL CIRCUIT FOR EXTENDING CHARGING TIME

(71) Applicant: AU Optronics Corporation, Hsin-Chu (TW)

(72) Inventors: Ching-Huan Lin, Hsin-Chu (TW); Chia-Ting Hsieh, Hsin-Chu (TW); Norio Sugiura, Hsin-Chu (TW); Fang-Chen Luo, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 83 days.

(21) Appl. No.: 14/995,384

(22) Filed: Jan. 14, 2016

(65) Prior Publication Data

US 2016/0314754 A1 Oct. 27, 2016

(30) Foreign Application Priority Data

Apr. 23, 2015 (TW) ..... 104113063 A

(51) Int. Cl.
*G09G 3/36* (2006.01)

(52) U.S. Cl.
CPC ... *G09G 3/3659* (2013.01); *G09G 2300/0852* (2013.01)

(58) Field of Classification Search
CPC ..... G09G 3/3659; G09G 2300/0852
See application file for complete search history.

(56) References Cited

U.S. PATENT DOCUMENTS

| | | | | |
|---|---|---|---|---|
| 6,072,454 | A | 6/2000 | Nakai et al. | |
| 7,079,101 | B1 | 7/2006 | Asada | |
| 2008/0170022 | A1* | 7/2008 | Chen | G09G 3/3648 345/92 |
| 2011/0090196 | A1* | 4/2011 | Li | G09G 3/3648 345/209 |
| 2012/0019503 | A1* | 1/2012 | Lee | G09G 3/3659 345/211 |
| 2013/0320348 | A1* | 12/2013 | Liu | H01L 27/1255 257/71 |
| 2015/0042632 | A1 | 2/2015 | Amino | |

FOREIGN PATENT DOCUMENTS

CN 102750921 10/2012

* cited by examiner

*Primary Examiner* — Kwang-Su Yang
(74) *Attorney, Agent, or Firm* — WPAT, PC

(57) ABSTRACT

A pixel includes a voltage dividing unit, a LC capacitor, a control unit, a first capacitor, a writing-in unit, and an adjusting unit. First terminal of the voltage dividing unit receives a first power voltage. The control terminal of the voltage dividing unit receives a first control signal. The LC capacitor is electrically coupled to the second terminal of voltage dividing unit. The control terminal of the control unit receives a second control signal. The writing-in unit provides a first pixel data signal to the first capacitor based on a third control signal. The adjusting unit receives a second power voltage. The adjusting unit divides voltage difference between the first and second power voltages based on the first pixel data signal stored in the first capacitor so as to control voltage stored in the LC capacitor, such that the LC corresponding to LC capacitor can be controlled.

11 Claims, 18 Drawing Sheets

100A6

100B2

100A5

100A7

100B4

100B5

100B7

PIXEL CIRCUIT FOR EXTENDING CHARGING TIME

RELATED APPLICATIONS

This application claims priority to Taiwan Application Serial Number 104113063, filed Apr. 23, 2015, which is herein incorporated by reference.

BACKGROUND

Field of Invention

The disclosure relates to a display technology. More particularly, the disclosure relates to a pixel.

Description of Related Art

With the constantly improving resolution of the liquid crystal display, the frame frequency becomes higher and higher. Because of this phenomenon, the turn-on time of the gate of a traditional pixel is shortened, which in turn causes the charging time to be shortened correspondingly. Hence, during the charging period, the electric field frequency sensed by liquid crystals (LCs) will become higher. When the above frequency exceeds a threshold frequency, the dielectric constant of LCs will become smaller so that the capacitance of the liquid crystal box also becomes smaller correspondingly. However, after the thin film transistor of a traditional pixel is turned off, the electric field of the liquid crystal box returns to a steady state and the dielectric constant of the LCs consequently returns to a larger value. Under the circumstances of a pixel system having fixed charges, the voltage across two terminals of the liquid crystal box will drop, which leads to abnormal brightness.

In order to mitigate such situation, storage capacitors having a large area are necessary in a display operating at a higher frequency (such as a field sequential display) or in a display adopting LCs having a high dielectric constant (such as blue phase LCs, ferroelectric LCs). As a result, an aperture ratio of the display is significantly decreased.

SUMMARY

An objective of the present embodiments is to provide a pixel.

A pixel is provided. The pixel comprises a first voltage dividing unit, a liquid crystal capacitor, a first control unit, a first capacitor, a first writing-in unit, and a first adjusting unit. The first voltage dividing unit has a first terminal, a second terminal, and a control terminal. The first terminal of the first voltage dividing unit is configured to receive a first power voltage. The control terminal of the first voltage dividing unit is configured to receive a first control signal and determine whether to conduct the first terminal to the second terminal of the first voltage dividing unit based on the first control signal. The liquid crystal capacitor is electrically coupled to the second terminal of the first voltage dividing unit. The first control unit is electrically coupled to the first voltage dividing unit. The first control unit has a first terminal, a second terminal, and a control terminal. The control terminal of the first control unit is configured to receive a second control signal and determine whether to conduct the first terminal to the second terminal of the first control unit based on the second control signal. The first writing-in unit is electrically coupled to the first capacitor and configured to provide a first pixel data signal to the first capacitor based on a third control signal. The first adjusting unit is electrically coupled to the first capacitor and configured to receive a second power voltage. The first adjusting unit is configured to, in cooperation with the first voltage dividing unit and the first control unit, divide a voltage difference between the first power voltage and the second power voltage based on the first pixel data signal stored in the first capacitor during a period when the first terminals and the second terminals of the first voltage dividing unit and the first control unit are conducted so as to control a voltage stored in the liquid crystal capacitor, such that a liquid crystal corresponding to the liquid crystal capacitor is controlled.

The other embodiment provides a pixel. The pixel comprises a first transistor, a liquid crystal capacitor, a second transistor, a first capacitor, a third transistor, and a fourth transistor. Each of the first transistor, the second transistor, the third transistor, and the fourth transistor comprises a first terminal, a second terminal, and a control terminal. Each of the liquid crystal capacitor and the first capacitor comprises a first terminal and the second terminal. The first terminal of the first transistor is configured to receive a first power voltage. The control terminal of the first transistor is configured to receive a first control signal and determine whether to conduct the first terminal to the second terminal of the first transistor based on the first control signal. The first terminal of the liquid crystal capacitor is electrically coupled to the second terminal of the first transistor. The control terminal of the second transistor is configured to receive a second control signal and determine whether to conduct the first terminal to the second terminal of the second transistor based on the second control signal. The first terminal of the third transistor is configured to receive a first pixel data signal. The second terminal of the third transistor is electrically coupled to the first terminal of the first capacitor. The control terminal of the third transistor is configured to receive a third control signal and provide the first pixel data signal to the first capacitor based on the third control signal. The first terminal of the fourth transistor is electrically coupled to the second terminal of the first transistor. The second terminal of the fourth transistor is configured to receive a second power voltage. The control terminal of the fourth transistor is electrically coupled to the first terminal of the first capacitor.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

Figure 1A:
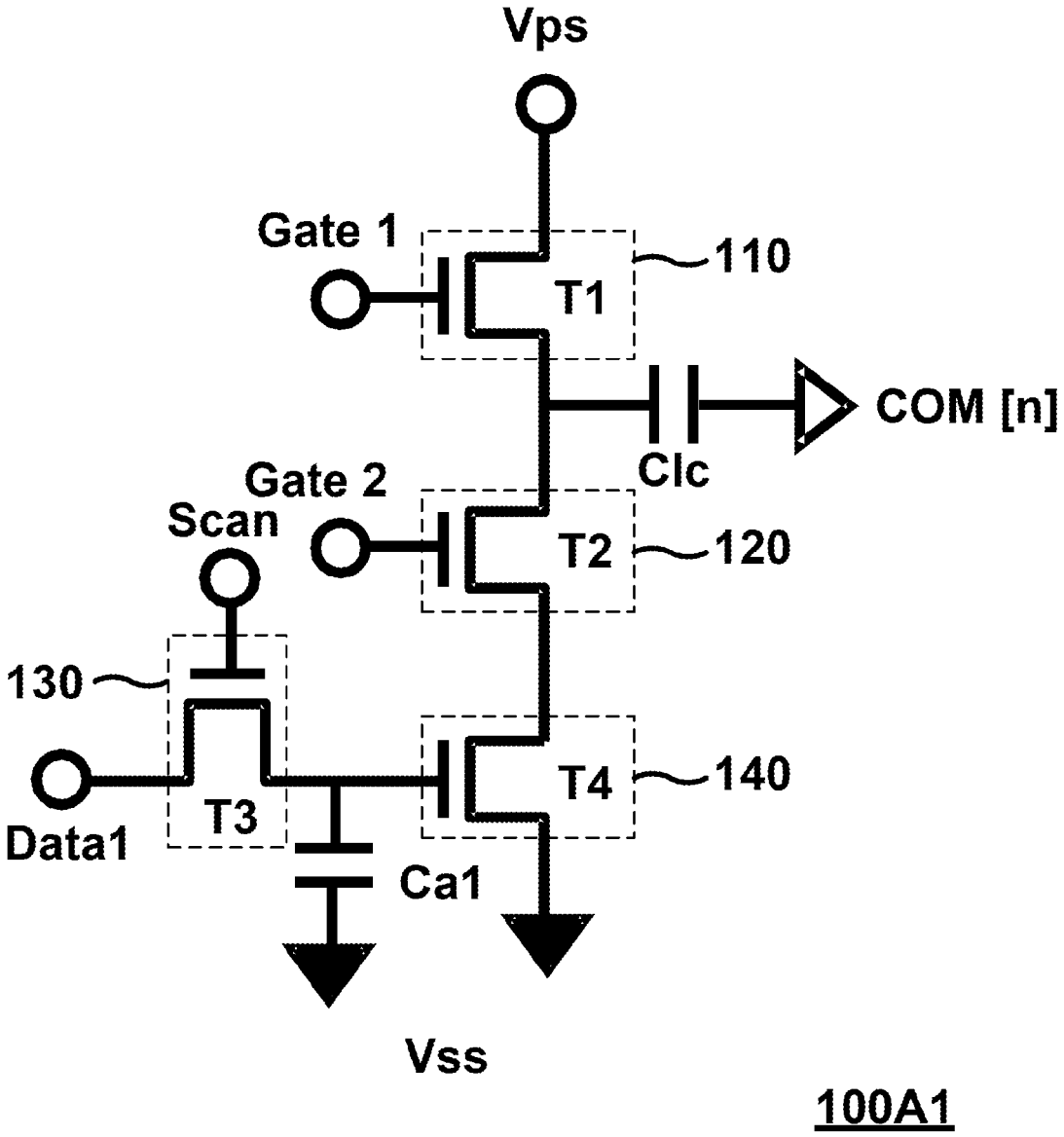
FIG. 1A depicts a schematic diagram of a pixel according to one embodiment of this invention.

In accordance with common practice, the various described features/elements are not drawn to scale but instead are drawn to best illustrate specific features/elements relevant to the present invention. Also, like reference numerals and designations in the various drawings are used to indicate like elements/parts.

DESCRIPTION OF THE EMBODIMENTS

To make the contents of the present disclosure more thorough and complete, the following illustrative description is given with regard to the implementation aspects and embodiments of the present invention, which is not intended to limit the scope of the present invention. The features of the embodiments and the steps of the method and their sequences that constitute and implement the embodiments are described. However, other embodiments may be used to achieve the same or equivalent functions and step sequences.

Unless otherwise defined herein, scientific and technical terminologies employed in the present disclosure shall have the meanings that are commonly understood and used by one of ordinary skill in the art. Unless otherwise required by context, it will be understood that singular terms shall include plural forms of the same and plural terms shall include the singular. Specifically, as used herein and in the claims, the singular forms "a" and "an" include the plural reference unless the context clearly indicates otherwise.

As used herein, "couple" refers to direct physical contact or electrical contact or indirect physical contact or electrical contact between two or more devices. Or it can also refer to reciprocal operations or actions between two or more devices.

The embodiments of the present invention provide a pixel that is described as follows. The pixel can improve the problems of insufficient charges and reduced voltage and brightness caused by the decreased dielectric constant of LCs when the pixel is charged at a high frequency.

FIG. 1A depicts a schematic diagram of a pixel according to one embodiment of this invention. As shown in the figure, a pixel 100A1 comprises a first voltage dividing unit 110, a liquid crystal (LC) capacitor Clc, a first control unit 120, a first writing-in unit 130, a first capacitor Ca1, and a first adjusting unit 140. The first voltage dividing unit 110 has a first terminal, a second terminal, and a control terminal. The first terminal of the first voltage dividing unit 110 is configured to receive a first power voltage Vps. The control terminal of the first voltage dividing unit 110 is configured to receive a first control signal Gate 1 and determine whether to conduct the first terminal to the second terminal of the first voltage dividing unit 110 based on the first control signal Gate 1. One terminal of the LC capacitor Clc is electrically coupled to the second terminal of the first voltage dividing unit 110. Another terminal of the LC capacitor Clc is configured to receive a common voltage COM[n]. The first control unit 120 is electrically coupled to the first voltage dividing unit 110. The first control unit 120 has a first terminal, a second terminal, and a control terminal. The control terminal of the first control unit 120 is configured to receive a second control signal Gate 2 and determine whether to conduct the first terminal to the second terminal of the first control unit 120 based on the second control signal Gate 2.

In addition, the first writing-in unit 130 is electrically coupled to the first capacitor Ca1 and configured to provide a first pixel data signal Data 1 to the first capacitor Ca1 based on a third control signal Scan. The first adjusting unit 140 is electrically coupled to the first capacitor Ca1 and configured to receive a second power voltage Vss. While the first terminals and the second terminals of the first voltage dividing unit 110 and the first control unit 120 are conducted, the first adjusting unit 140 also divides a voltage difference between the first power voltage Vps and the second power voltage Vss based on the first pixel data signal Data 1 stored in the first capacitor Ca1 and in cooperation with the first voltage dividing unit 110 and the first control unit 120 so as to control a voltage stored in the LC capacitor Clc, such that an LC corresponding to the LC capacitor Clc can be controlled.

Hence, the first adjusting unit 140 can adjust its resistivity based on the first pixel data signal Data 1 stored in the first capacitor Ca1. After writing in the first pixel data signal Data 1, the first adjusting unit 140 can cooperate with the first voltage dividing unit 110 to control the voltage stored in the LC capacitor Clc so as to continuously control the LC corresponding to the LC capacitor Clc through the first voltage dividing unit 110 and the first power voltage Vps. As compared with a traditional LC pixel structure, after a pixel data signal is written in this row of pixels, this row of LC capacitors Clc can still be continuously charged even when another row of pixels are written in the pixel data signal. As a result, the problems of insufficient charges and reduced voltage and brightness caused by the decreased dielectric constant of the LCs when the pixel is charged at a high frequency are mitigated.

When implementing the present embodiment, the first voltage dividing unit 110, the first control unit 120, the first writing-in unit 130, and the first adjusting unit 140 can be respectively implemented by a first transistor T1, a second transistor T2, a third transistor T3, and a fourth transistor T4. Each of the first transistor T1, the second transistor T2, the third transistor T3, and the fourth transistor T4 comprises a first terminal, a second terminal, and a control terminal. The first terminal of the first transistor T1 is configured to receive the first power voltage Vps. The control terminal of the first transistor T1 is configured to receive the first control signal Gate 1 and determine whether to conduct the first terminal to the second terminal of the first transistor T1 based on the first control signal Gate 1. Additionally, the LC capacitor Clc comprises a first terminal and a second terminal. The first terminal of the LC capacitor Clc is electrically coupled to the second terminal of the first transistor T1. The control terminal of the second transistor T2 is configured to receive the second control signal Gate 2 and determine whether to conduct the first terminal to the second terminal of the second transistor T2 based on the second control signal Gate 2. Thus, after a charging process of the LC capacitor Clc is completed, the pixel 100A1 can turn off the first transistor T1 and the second transistor T2 so as to reduce the power loss.

In addition to that, the first capacitor Ca1 comprises a first terminal and a second terminal. The first terminal of the third transistor T3 is configured to receive the first pixel data signal Data 1. The second terminal of the third transistor T3 is electrically coupled to the first terminal of the first capacitor Ca1. The control terminal of the third transistor T3 is configured to receive the third control signal Scan and provide the first pixel data signal Data 1 to the first capacitor Ca1 based on the third control signal Scan. The first terminal of the fourth transistor T4 is electrically coupled to the second terminal of the first transistor T1 (direct or indirect electrical coupling). The second terminal of the fourth transistor T4 is configured to receive the second power voltage Vss. The control terminal of the fourth transistor T4 is electrically coupled to the first terminal of the first capacitor Ca1.

In another embodiment, the first control unit 120 is configured to turn on or off a current path between the first adjusting unit 140 and the first voltage dividing unit 110 based on the second control signal Gate 2. When implementing the present invention, the first voltage dividing unit 110, the first control unit 120, the first writing-in unit 130, and the first adjusting unit 140 can be respectively implemented by the first transistor T1, the second transistor T2, the third transistor T3, and the fourth transistor T4. The first terminal of the second transistor T2 is electrically coupled to the second terminal of the first transistor T1. The second terminal of the second transistor T2 is electrically coupled to the first terminal of the fourth transistor T4. The control terminal of the second transistor T2 is configured to receive the second control signal Gate 2.

Figure 1B:
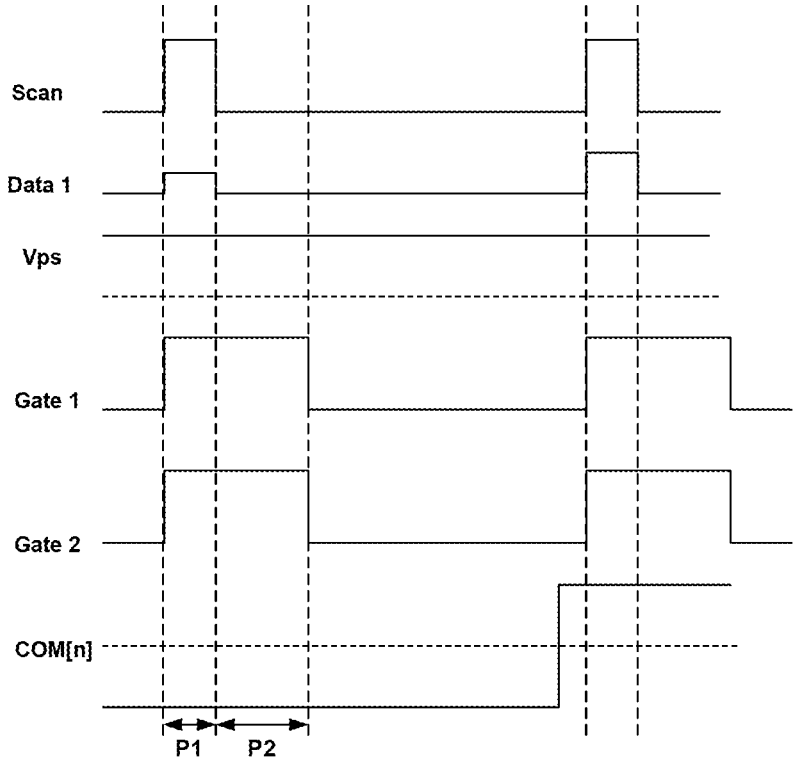
FIG. 1B depicts a schematic diagram of signal waveforms according to still another embodiment of this invention.

FIG. 1B depicts a schematic diagram of signal waveforms according to still another embodiment of this invention. As shown in the figure, during a period P1, the first power voltage Vps is a high voltage (the dashed line in the figure represents a low voltage level of the first power voltage Vps), the common voltage COM[n] is a low voltage, the first control signal Gate 1 and the second control signal Gate 2 are both high-level signals, and the third control signal Scan is the high-level signal. The control terminal of the first transistor T1 conducts the first terminal to the second terminal of the first transistor T1 based on the high-level first control signal Gate 1. The control terminal of the second transistor T2 is configured to conduct the first terminal to the second terminal of the second transistor T2 based on the high-level second control signal Gate 2. The third transistor T3 is turned on based on the high-level third control signal Scan so as to provide the first pixel data signal Data 1 to the first capacitor Ca1. The fourth transistor T4 is configured to receive the second power voltage Vss and divide the voltage difference between the first power voltage Vps and the second power voltage Vss based on the first pixel data signal Data 1 stored in the first capacitor Ca1 in cooperation with the first transistor T1 and the second transistor T2 so as to control the voltage stored in the LC capacitor Clc, such that the LC corresponding to the LC capacitor Clc can be controlled.

Then, during a period P2, the first power voltage Vps is kept at the high voltage, the first control signal Gate 1 and the second control signal Gate 2 are also kept at a high-level state, and the third control signal Scan and the first pixel data signal Data 1 become low-level signals. During this period, the first transistor T1 and the second transistor T2 are conducted respectively based on the first control signal Gate 1 and the second control signal Gate 2. Hence, the LC capacitor Clc is provided with extra charging and discharging time to reduce the operating frequency. After that, when the charging process of the LC capacitor Clc is completed (for example after the period P2), both the first control signal Gate 1 and the second control signal Gate 2 are changed to be the low-level signals. The first transistor T1 and the second transistor T2 are thus turned off to reduce the power loss.

Figure 2:
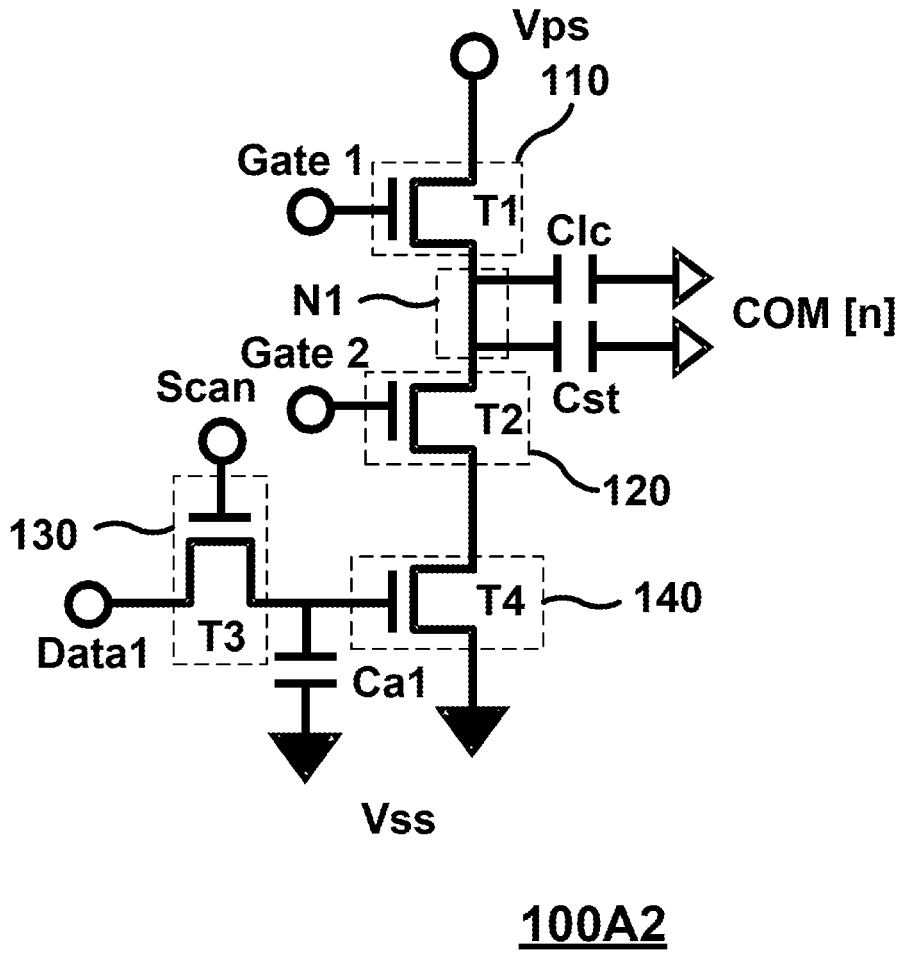
FIG. 2 depicts a schematic diagram of a pixel according to another embodiment of this invention.

FIG. 2 depicts a schematic diagram of a pixel according to another embodiment of this invention. As shown in the figure, the two terminals of the first control unit 120 of a pixel 100A2 are electrically coupled to the first voltage dividing unit 110 and the first adjusting unit 140, respectively. As compared with the pixel 100A1 shown in FIG. 1A, the pixel 100A2 in FIG. 2 further comprises a storage capacitor Cst. The first control unit 120 and the first voltage dividing unit 110 are electrically coupled at a node N1. The above-mentioned storage capacitor Cst and LC capacitor Clc are both electrically coupled to the node N1. When implementing the embodiment, the first voltage dividing unit 110, the first control unit 120, the first writing-in unit 130, and the first adjusting unit 140 can be respectively implemented by the first transistor T1, the second transistor T2, the third transistor T3, and the fourth transistor T4. The first terminal of the second transistor T2 and the second terminal of the first transistor T1 are electrically coupled at the node N1. Both the above-mentioned storage capacitor Cst and LC capacitor Clc are electrically coupled to the node N1. The additional storage capacitor Cst is able to compensate for a loss of the LC capacitor Clc when the LC capacitor Clc has a leakage phenomenon.

Figure 3:
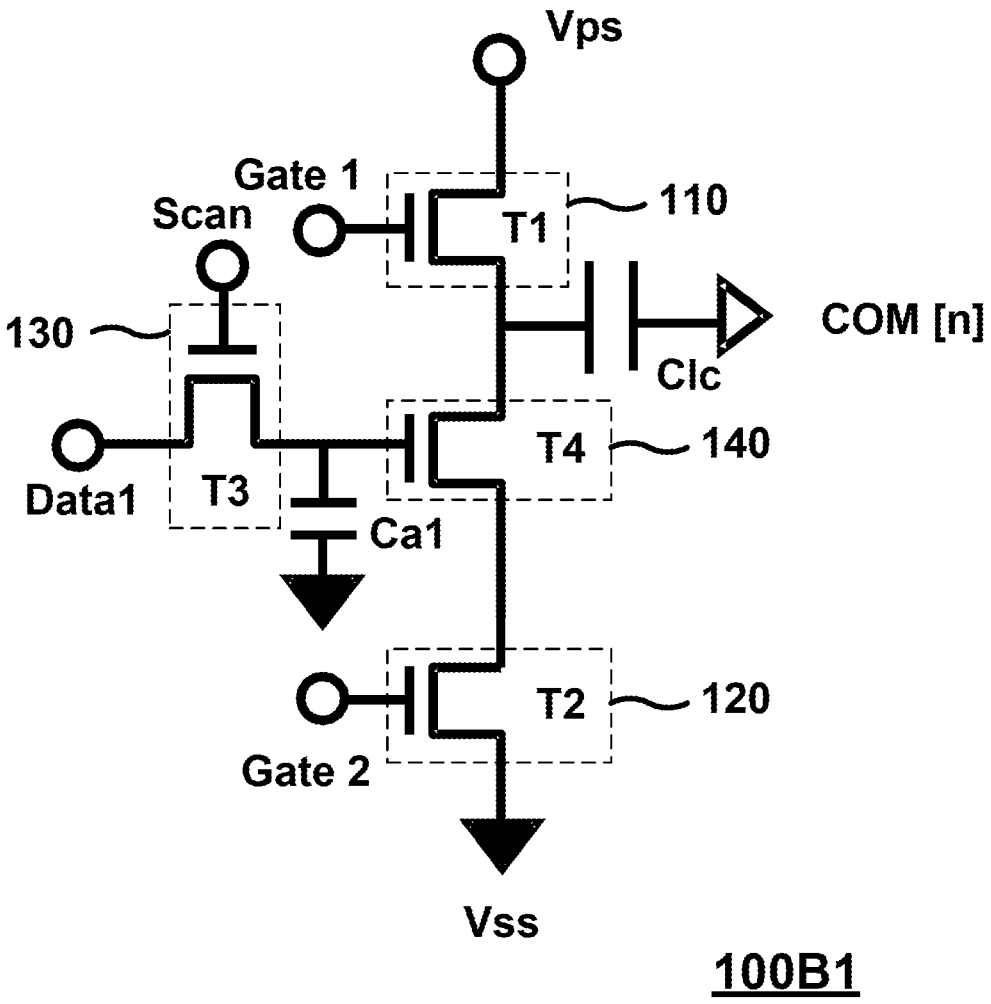
FIG. 3 depicts a schematic diagram of a pixel according to still another embodiment of this invention.

FIG. 3 depicts a schematic diagram of a pixel according to still another embodiment of this invention. As compared with the pixel 100A1 shown in FIG. 1A, the two terminals of the first adjusting unit 140 of a pixel 100B1 shown in FIG. 3 are electrically coupled to the first voltage dividing unit 110 and the first control unit 120, respectively. When implementing the embodiments of the present invention, the first voltage dividing unit 110, the first control unit 120, the first writing-in unit 130, and the first adjusting unit 140 can be respectively implemented by the first transistor T1, the second transistor T2, the third transistor T3, and the fourth transistor T4. The first terminal of the fourth transistor T4 is electrically coupled to the second terminal of the first transistor T1. The second terminal of the fourth transistor T4 is electrically coupled to the first terminal of the second transistor T2. In another embodiment, the first terminal of the second transistor T2 is electrically coupled to the second terminal of the fourth transistor T4. The second terminal of the second transistor T2 is configured to receive the second power voltage Vss. The control terminal of the second transistor T2 is configured to receive the second control signal Gate 2.

Figure 4:
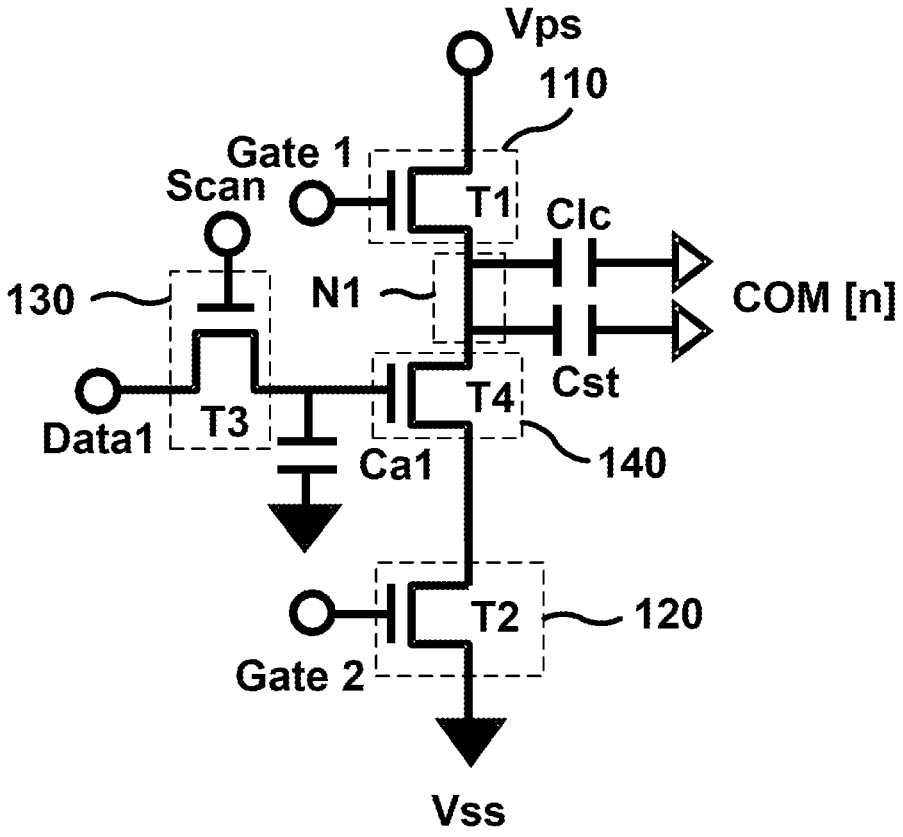
FIG. 4 depicts a schematic diagram of a pixel according to yet another embodiment of this invention.

FIG. 4 depicts a schematic diagram of a pixel according to yet another embodiment of this invention. As compared with the pixel 100B1 shown in FIG. 3, a pixel 100B2 shown in FIG. 4 further comprises the storage capacitor Cst. The first adjusting unit 140 and the first voltage dividing unit 110 are electrically coupled at the node N1. The above-mentioned storage capacitor Cst and LC capacitor Clc are both electrically coupled to the node N1. When implementing the present invention, the first voltage dividing unit 110, the first control unit 120, the first writing-in unit 130, and the first adjusting unit 140 can be respectively implemented by the first transistor T1, the second transistor T2, the third transistor T3, and the fourth transistor T4. The first terminal of the fourth transistor T4 and the second terminal of the first transistor T1 are electrically coupled at the node N1. Both the above-mentioned storage capacitor Cst and LC capacitor Clc are coupled to the node N1. The storage capacitor Cst is able to compensate for the loss of the LC capacitor Clc when the LC capacitor Clc has the leakage phenomenon. In addition, the pixel 100B2 in FIG. 4 can be controlled by adopting the signal waveforms shown in FIG. 1B. Since operating methods of internal devices of the pixel 100B2 are similar to those of the relevant devices in FIG. 1B, a description in this regard is not provided.

Figure 5A:
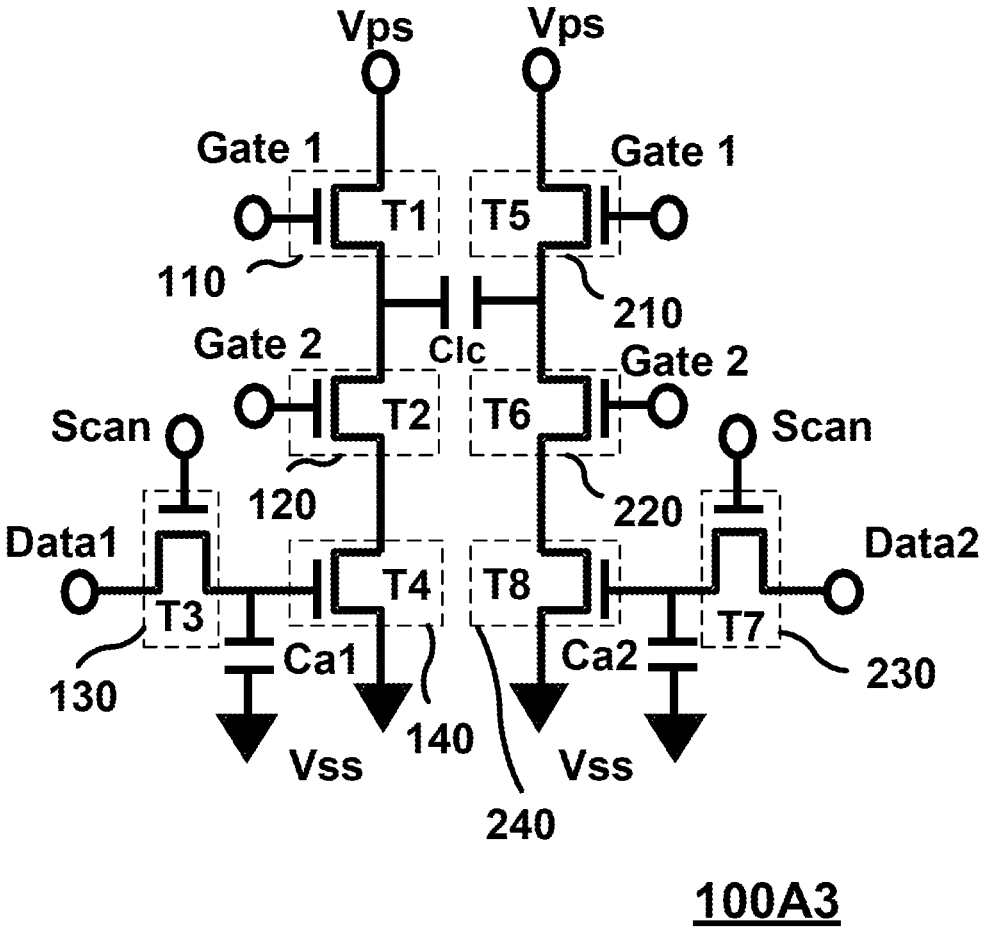
FIG. 5A depicts a schematic diagram of a pixel according to another embodiment of this invention.

FIG. 5A depicts a schematic diagram of a pixel according to another embodiment of this invention. As compared with the pixel 100A1 shown in FIG. 1A, a pixel 100A3 shown in FIG. 5A further comprises a second voltage dividing unit 210, a second control unit 220, a second writing-in unit 230, a second capacitor Ca2, and a second adjusting unit 240. The second voltage dividing unit 210 has a first terminal, a second terminal, and a control terminal. The first terminal of the second voltage dividing unit 210 is configured to receive the first power voltage Vps. The second terminal of the second voltage dividing unit 210 is electrically coupled to the LC capacitor Clc. The control terminal of the second voltage dividing unit 210 is configured to receive the first control signal Gate 1 and determine whether to conduct the first terminal to the second terminal of the second voltage dividing unit 210 based on the first control signal Gate 1. The second control unit 220 is electrically coupled to the second voltage dividing unit 210. The second control unit 220 has a first terminal, a second terminal, and a control terminal. The control terminal of the second control unit 220 is configured to receive the second control signal Gate 2 and determine whether to conduct the first terminal to the second terminal of the second control unit 220 based on the second control signal Gate 2.

In addition, the second writing-in unit 230 is electrically coupled to the second capacitor Ca2 and configured to provide a second pixel data signal Data 2 to the second capacitor Ca2 based on the third control signal Scan. The second adjusting unit 240 is electrically coupled to the second capacitor Ca2 and configured to receive the second power voltage Vss. While the first terminals and the second terminals of the second voltage dividing unit 210 and the second control unit 220 are conducted, the second adjusting unit 240 also divides the voltage difference between the first power voltage Vps and the second power voltage Vss based on the second pixel data signal Data 2 stored in the second capacitor Ca2 in cooperation with the second voltage dividing unit 210 and the second control unit 220 so as to control the voltage stored in the LC capacitor Clc, such that the LC corresponding to the LC capacitor Clc can be controlled.

When implementing the embodiment of the present invention, the second voltage dividing unit 210, the second control unit 220, the second writing-in unit 230, and the second adjusting unit 240 can be respectively implemented by a fifth transistor T5, a sixth transistor T6, a seventh transistor T7, and an eighth transistor T8. Each of the fifth transistor T5, the sixth transistor T6, the seventh transistor T7, and the eighth transistor T8 comprises a first terminal, a second terminal, and a control terminal. The first terminal of the fifth transistor T5 is configured to receive the first power voltage Vps. The second terminal of the fifth transistor T5 is electrically coupled to the LC capacitor Clc. The control terminal of the fifth transistor T5 is configured to receive the first control signal Gate 1 and determine whether to conduct the first terminal to the second terminal of the fifth transistor T5 based on the first control signal Gate 1. The sixth transistor T6 is electrically coupled to the fifth transistor T5. The sixth transistor T6 has a first terminal, a second terminal, and a control terminal. The control terminal is configured to receive the second control signal Gate 2 and determine whether to conduct the first terminal to the second terminal of the sixth transistor T6 based on the second control signal Gate 2. The second capacitor Ca2 comprises a first terminal and a second terminal.

In addition to that, the first terminal of the seventh transistor T7 is configured to receive the second pixel data signal Data 2. The second terminal of the seventh transistor T7 is electrically coupled to the first terminal of the second capacitor Ca2. The control terminal of the seventh transistor T7 is configured to receive the third control signal Scan and provide the second pixel data signal Data 2 to the second capacitor Ca2 based on the third control signal Scan. The first terminal of the eighth transistor T8 is electrically coupled to the second terminal of the fifth transistor T5. The second terminal of the eighth transistor T8 is configured to receive the second power voltage Vss. The control terminal of the eighth transistor T8 is electrically coupled to the first terminal of the second capacitor Ca2. While the first terminals and the second terminals of the fifth transistor T5 and the sixth transistor T6 are conducted, the eighth transistor T8 also divides the voltage difference between the first power voltage Vps and the second power voltage Vss based on the second pixel data signal Data 2 stored in the second capacitor Ca2 and in cooperation with the fifth transistor T5 and the sixth transistor T6 so as to control the voltage stored in the LC capacitor Clc, such that the LC corresponding to the LC capacitor Clc can be controlled.

In the configurative method shown in FIG. 5A, when threshold voltages of the transistors T1-T8 change, changes of the threshold voltages of the transistors T1-T4 would be substantially consistent with changes of the threshold voltages of the transistors T5-T8 because a symmetrical circuit configuration is adopted, which in turn lessens the impact on the voltage stored in the LC capacitor Clc.

In another embodiment, the second control unit 220 is configured to turn on or off a current path between the second adjusting unit 240 and the second voltage dividing unit 210 based on the second control signal Gate 2. When implementing the embodiment of the present invention, the second voltage dividing unit 210, the second control unit 220, the second writing-in unit 230, and the second adjusting unit 240 can be respectively implemented by the fifth transistor T5, the sixth transistor T6, the seventh transistor T7, and the eighth transistor T8. The first terminal of the sixth transistor T6 is electrically coupled to the second terminal of the fifth transistor T5. The second terminal of the sixth transistor T6 is electrically coupled to the first terminal of the eighth transistor T8. The control terminal of the sixth transistor T6 is configured to receive the second control signal Gate 2.

Figure 5B:
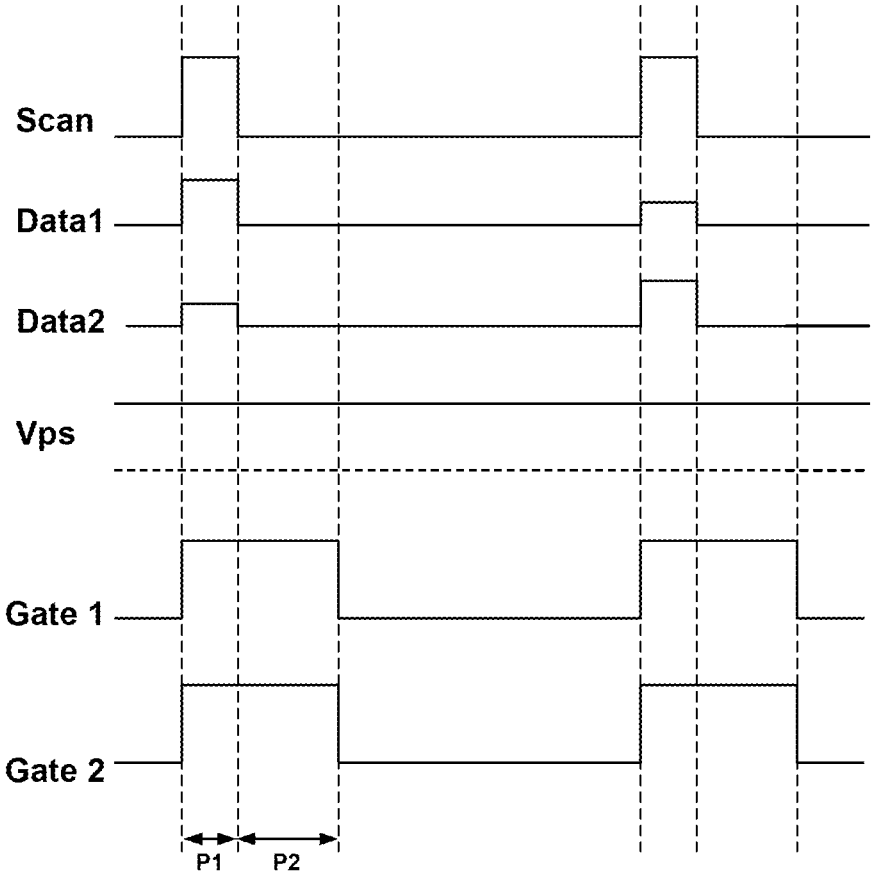
FIG. 5B depicts a schematic diagram of signal waveforms according to yet another embodiment of this invention.

FIG. 5B depicts a schematic diagram of signal waveforms according to yet another embodiment of this invention. As shown in the figure, during the period P1, the first power voltage Vps is the high voltage (the dashed line in the figure represents the low voltage level of the first power voltage Vps). The first control signal Gate 1 and the second control signal Gate 2 are both the high-level signals, and the third control signal Scan is the high-level signal. The control terminals of the first transistor T1 and the fifth transistor T5 conduct the first terminals to the second terminals of the first transistor T1 and the fifth transistor T5 based on the high-level first control signal Gate 1. The control terminals of the second transistor T2 and the sixth transistor T6 are configured to conduct the first terminals to the second terminals of the second transistor T2 and the sixth transistor T6 based on the high-level second control signal Gate 2. The third transistor T3 and the seventh transistor T7 are turned on based on the high-level third control signal Scan so as to provide the first pixel data signal Data 1 and the second pixel data signal Data 2 to the first capacitor Ca1 and the second capacitor Ca2, respectively.

Additionally, the fourth transistor T4 is configured to receive the second power voltage Vss and divide the voltage difference between the first power voltage Vps and the second power voltage Vss based on the first pixel data signal Data 1 stored in the first capacitor Ca1 and in cooperation with the first transistor T1 and the second transistor T2. The eighth transistor T8 is configured to receive the second power voltage Vss and divide the voltage difference between the first power voltage Vps and the second power voltage Vss based on the second pixel data signal Data 2 stored in the second capacitor Ca2 in cooperation with the fifth transistor T5 and the sixth transistor T6. The voltage stored in the LC capacitor Clc is thus controlled so as to control the LC corresponding to the LC capacitor Clc.

Then, during the period P2, the first power voltage Vps is kept at the high voltage, the first control signal Gate 1 and the second control signal Gate 2 are also kept at the high-level state, and the third control signal Scan, the first pixel data signal Data 1, and the second pixel data signal Data 2 become the low-level signals. During this period, the first transistor T1 and the fifth transistor T5 are conducted based on the first control signal Gate 1 correspondingly, and the second transistor T2 and the sixth transistor T6 are conducted based on the second control signal Gate 2 correspondingly. Hence, the LC capacitor Clc is provided with extra charging and discharging time to reduce the operating frequency. After that, when the charging process of the LC capacitor Clc is completed (for example after the period P2), both the first control signal Gate 1 and the second control signal Gate 2 are changed to be the low-level signals. The first transistor T1, the second transistor T2, the fifth transistor T5, and the sixth transistor T6 are thus turned off to reduce the power loss.

Figure 6A:
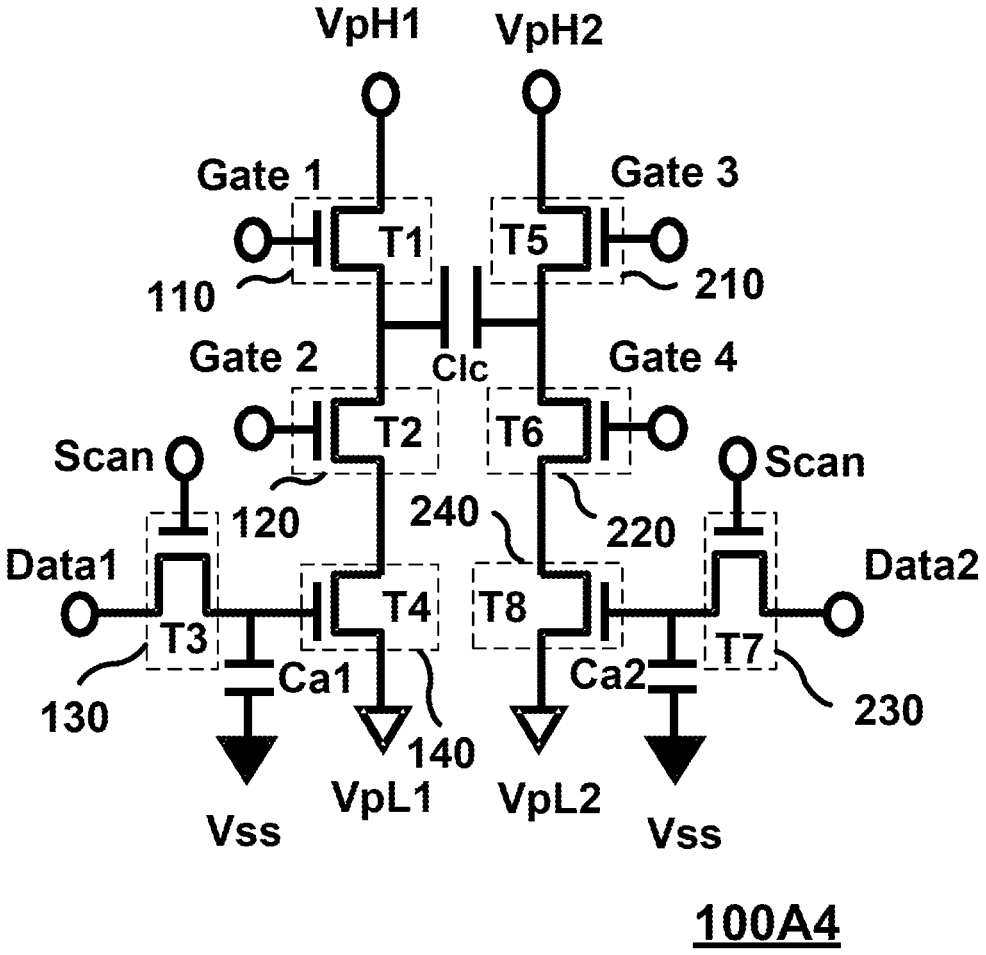
FIG. 6A depicts a schematic diagram of a pixel according to still another embodiment of this invention.

FIG. 6A depicts a schematic diagram of a pixel according to still another embodiment of this invention. As compared with the pixel 100A3 shown in FIG. 5A, the first voltage dividing unit 110 and the second voltage dividing unit 210 in a pixel 100A4 shown in FIG. 6A are respectively configured to receive a first power voltage VpH1 and a third power voltage VpH2. The first adjusting unit 140 and the second adjusting unit 240 are respectively configured to receive a second power voltage VpL1 and a fourth power voltage VpL2. When implementing the embodiment of the present invention, the second voltage dividing unit 210, the second control unit 220, the second writing-in unit 230, and the second adjusting unit 240 can be respectively implemented by the fifth transistor T5, the sixth transistor T6, the seventh transistor T7, and the eighth transistor T8. The first terminal of the first transistor T1 and the first terminal of the fifth transistor T5 are respectively configured to receive the first power voltage VpH1 and the third power voltage VpH2. The second terminal of the fourth transistor T4 and the second terminal of the eighth transistor T8 are respectively configured to receive the second power voltage VpL1 and the fourth power voltage VpL2. In the configurative method shown in FIG. 6A, the advantage is that the first power voltage VpH1, the second power voltage VpL1, the third power voltage VpH2, and the fourth power voltage VpL2 may be adjusted to different voltages so as to further increase a voltage difference reflecting the voltage stored in the LC capacitor Clc.

Figure 6B:
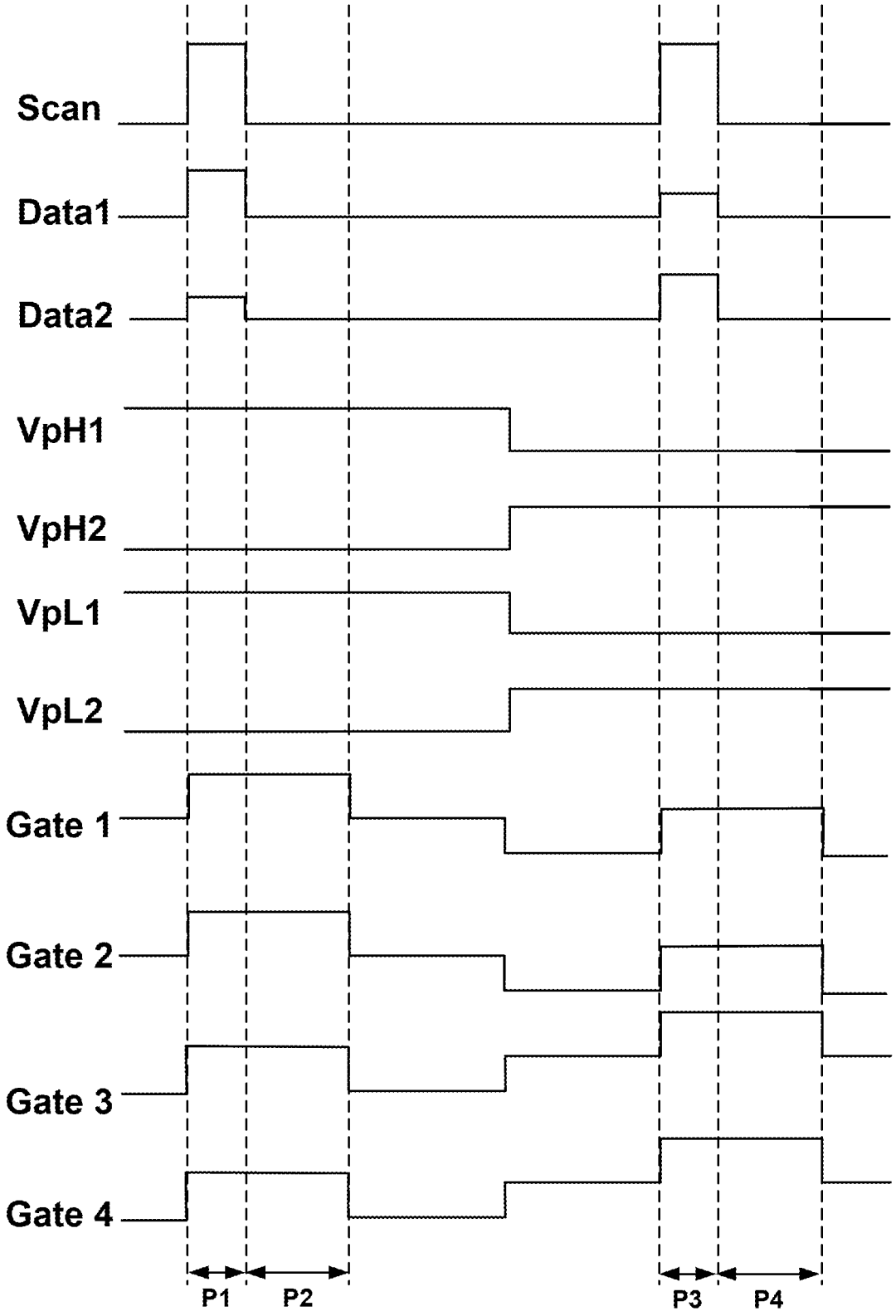
FIG. 6B depicts a schematic diagram of signal waveforms according to another embodiment of this invention.

FIG. 6B depicts a schematic diagram of signal waveforms according to another embodiment of this invention. In addition to that, the fundamental operating principle for controlling the pixel 100A4 in FIG. 6A by adopting the signal waveforms shown in FIG. 6B is similar to the fundamental operating principle for controlling the pixel 100A3 shown in FIG. 5A by adopting the signal waveforms shown in FIG. 5B. The major difference between them is that the first power voltage VpH1 and the third power voltage VpH2 respectively received by the first transistor T1 and the fifth transistor T5 are different from each other, and the second power voltage VpL1 and the fourth power voltage VpL2 respectively received by the fourth transistor T4 and the eighth transistor T8 are different from each other.

For example, during the period P1, the first power voltage VpH1 is the high voltage. The third power voltage VpH2 is the low voltage. The second power voltage VpL1 is the high voltage. The fourth power voltage VpL2 is the low voltage. In addition, during a period P3, the first power voltage VpH1 is the low voltage. The third power voltage VpH2 is the high voltage. The second power voltage VpL1 is the low voltage. The fourth power voltage VpL2 is the high voltage. It is understood that the above first power voltage VpH1, the second power voltage VpL1, the third power voltage VpH2, and the fourth power voltage VpL2 can actually be adjusted to different voltages so as to further increase the voltage difference reflecting the voltage stored in the LC capacitor Clc. In another embodiment, for example, the first power voltage VpH1 can be set to Vps. The second power voltage VpL1 can be set to zero. The third power voltage VpH2 can be set to Vpp/2 and the fourth power voltage VpH2 can be set to −Vpp/2. Then, the voltage difference reflecting the voltage stored in the LC capacitor Clc is more greatly increased. Increasing the voltage difference reflecting the voltage stored in the LC capacitor Clc lets the mentioned embodiments become more compatible to some liquid crystal materials requiring a higher voltage in order to be effectively controlled.

Figure 7:
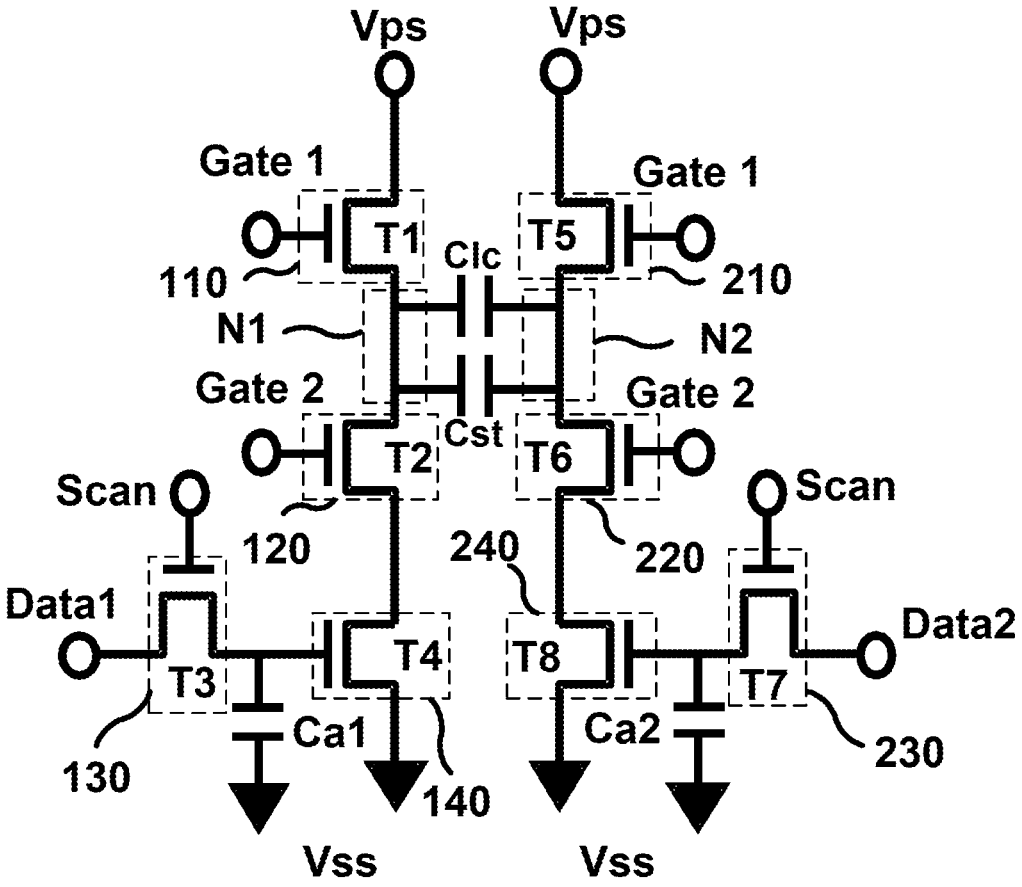
FIG. 7 depicts a schematic diagram of a pixel according to yet another embodiment of this invention.

FIG. 7 depicts a schematic diagram of a pixel according to yet another embodiment of this invention. As compared with the pixel 100A3 shown in FIG. 5A, a pixel 100A5 shown in FIG. 7 further comprises the storage capacitor Cst. The two terminals of the storage capacitor Cst are electrically coupled to the two terminals of the LC capacitor Clc, respectively. The reason it is necessary to dispose the additional storage capacitor Cst in the pixel 100A5 is that the storage capacitor Cst is able to compensate for the loss of the LC capacitor Clc when the LC capacitor Clc has the leakage phenomenon.

Figure 8:
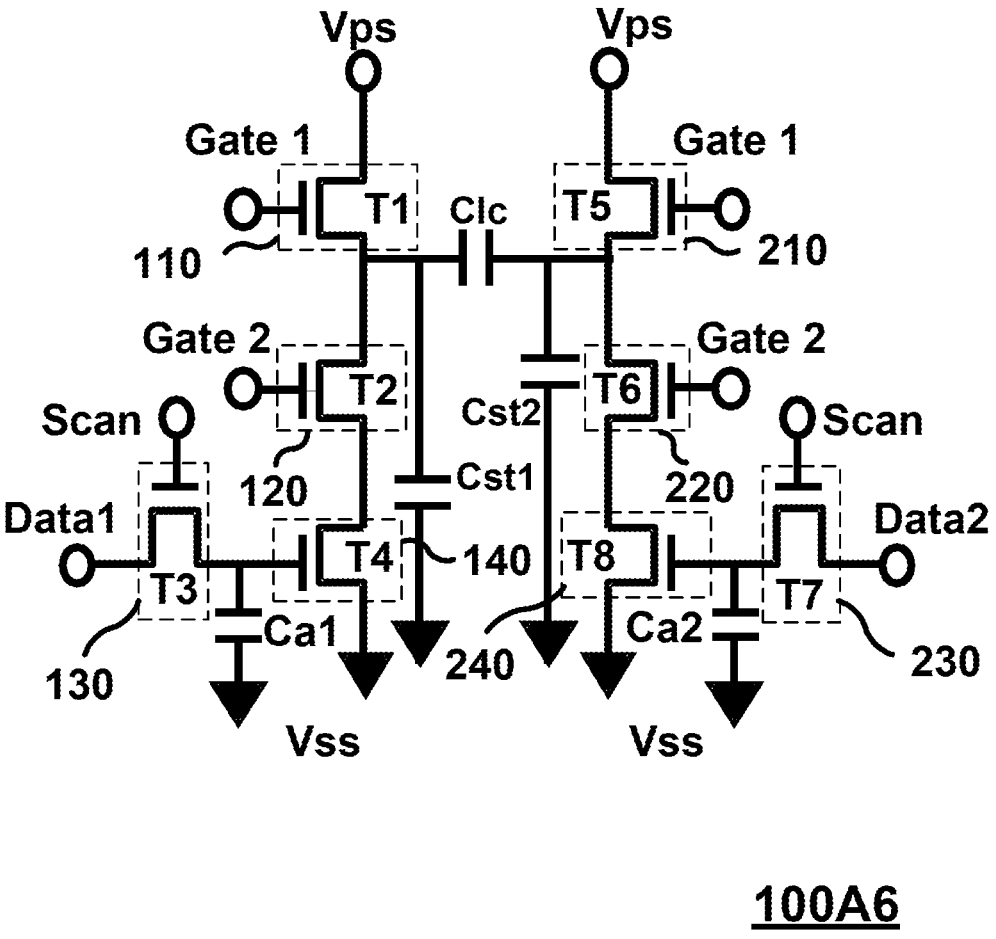
FIG. 8 depicts a schematic diagram of a pixel according to another embodiment of this invention.

FIG. 8 depicts a schematic diagram of a pixel according to another embodiment of this invention. As compared with the pixel 100A3 shown in FIG. 5A, a pixel 100A6 shown in FIG. 8 further comprises a first storage capacitor Cst1 and a second storage capacitor Cst2. One terminal of the first storage capacitor Cst1 is electrically coupled to the first terminal of the LC capacitor Clc. Another terminal of the first storage capacitor Cst1 is electrically coupled to the second terminal of the first adjusting unit 140. One terminal of the second storage capacitor Cst2 is electrically coupled to the second terminal of the LC capacitor Clc. Another terminal of the second storage capacitor Cst2 is electrically coupled to the second terminal of the second adjusting unit 240.

When implementing the embodiment of the present invention, the second voltage dividing unit 210, the second control unit 220, the second writing-in unit 230, and the second adjusting unit 240 can be respectively implemented by the fifth transistor T5, the sixth transistor T6, the seventh transistor T7, and the eighth transistor T8. The one terminal of the first storage capacitor Cst1 is electrically coupled to the first terminal of the LC capacitor Clc. The another terminal of the first storage capacitor Cst1 is electrically coupled to the second terminal of the fourth transistor T4. The one terminal of the second storage capacitor Cst2 is electrically coupled to the second terminal of the LC capacitor Clc. The another terminal of the second storage capacitor Cst2 is electrically coupled to the second terminal of the eighth transistor T8. The reason it is necessary to dispose the additional first storage capacitor Cst1 and second storage capacitor Cst2 in the pixel 100A6 is that the first storage capacitor Cst1 and the second storage capacitor Cst2 are able to compensate for the loss of the LC capacitor Clc when the LC capacitor Clc has the leakage phenomenon.

Figure 9A:
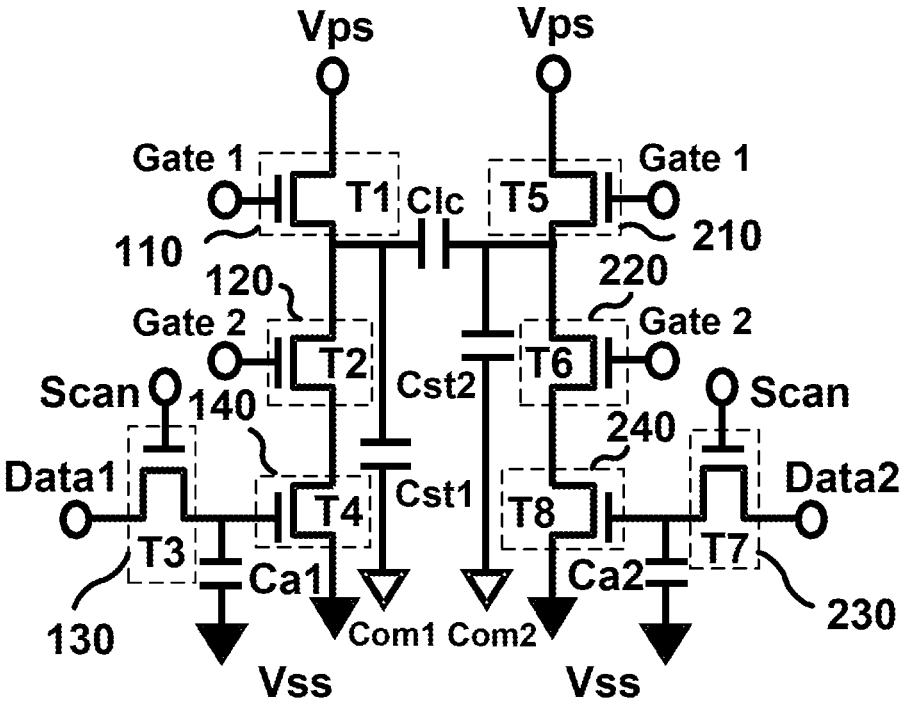
FIG. 9A depicts a schematic diagram of a pixel according to still another embodiment of this invention.

FIG. 9A depicts a schematic diagram of a pixel according to still another embodiment of this invention. As compared with the pixel 100A6 shown in FIG. 8, the another terminal of the first storage capacitor Cst1 is configured to receive a first common voltage Com1 and the another terminal of the second storage capacitor Cst2 is configured to receive a second common voltage Com2 in a pixel 100A7 shown in FIG. 9A. In the configurative method shown in FIG. 9A, the advantage is that the voltage difference reflecting the voltage stored in the LC capacitor Clc is further increased additionally by adopting the Com-Swing technique.

Figure 9B:
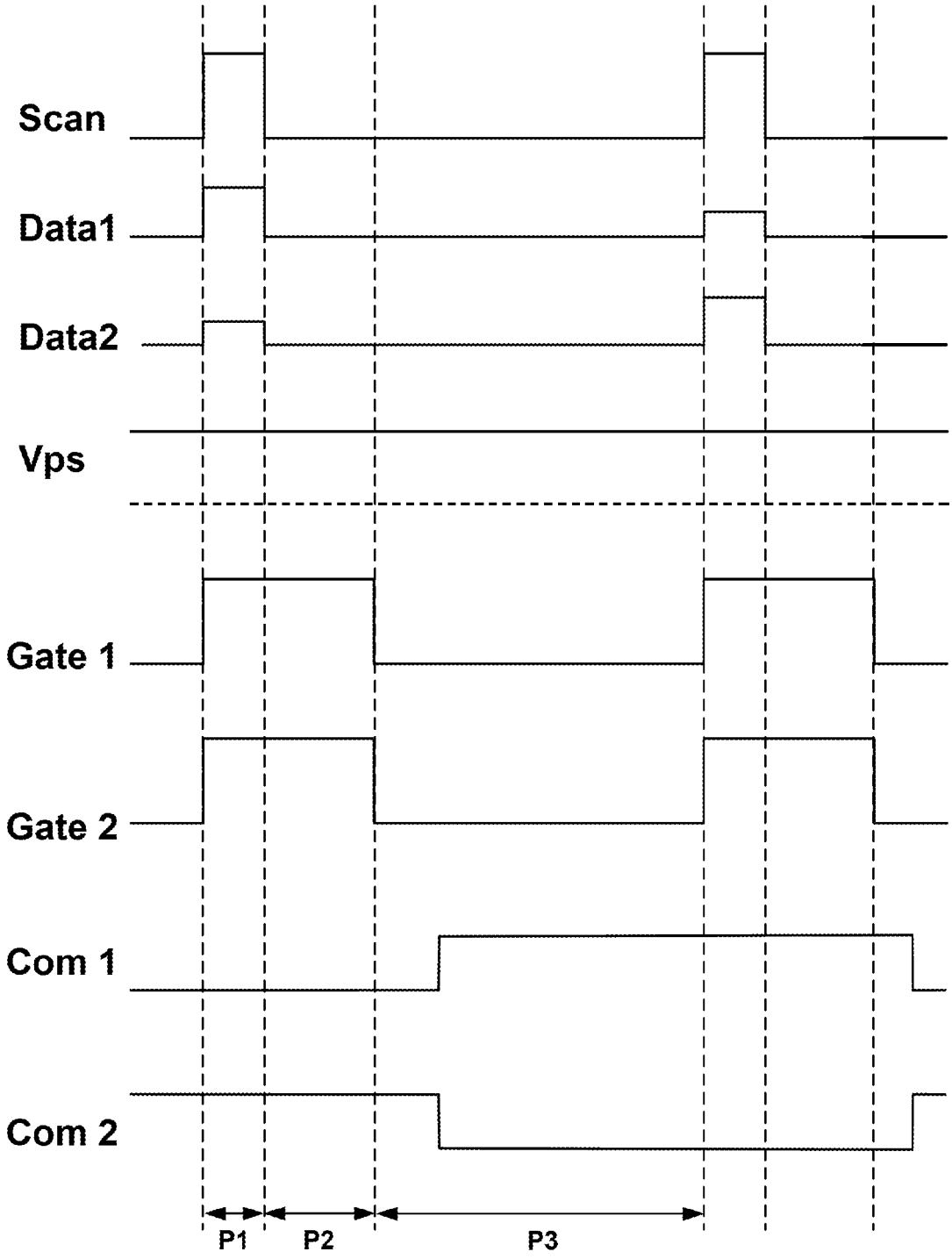
FIG. 9B depicts a schematic diagram of signal waveforms according to another embodiment of this invention.

FIG. 9B depicts a schematic diagram of signal waveforms according to another embodiment of this invention. In addition to that, the fundamental operating principle for controlling the pixel 100A7 in FIG. 9A by adopting the signal waveforms shown in FIG. 9B is similar to the fundamental operating principle for controlling the pixel 100A3 shown in FIG. 5A by adopting the signal waveforms shown in FIG. 5B. The major difference between them is that the pixel 100A7 in FIG. 9A adopts the Com-Swing technique shown in FIG. 9B additionally. A description is provided with reference to FIG. 9B. During the period P3, the first common voltage Com1 is changed to the high voltage, and the second common voltage Com2 is changed to the low voltage. Therefore, a high-voltage terminal of the two terminals of the LC capacitor Clc is pulled even higher and a low-voltage terminal of the two terminals of the LC capacitor Clc is pulled even lower. For example, if the voltage stored in the LC capacitor Clc is 17 volts, the voltage stored in the LC capacitor Clc will be increased to 27 volts after the Com-Swing operation. The objective of increasing the voltage difference reflecting the voltage stored in the LC capacitor Clc lies in that some liquid crystal materials require a higher voltage in order to be effectively controlled.

Figure 10:
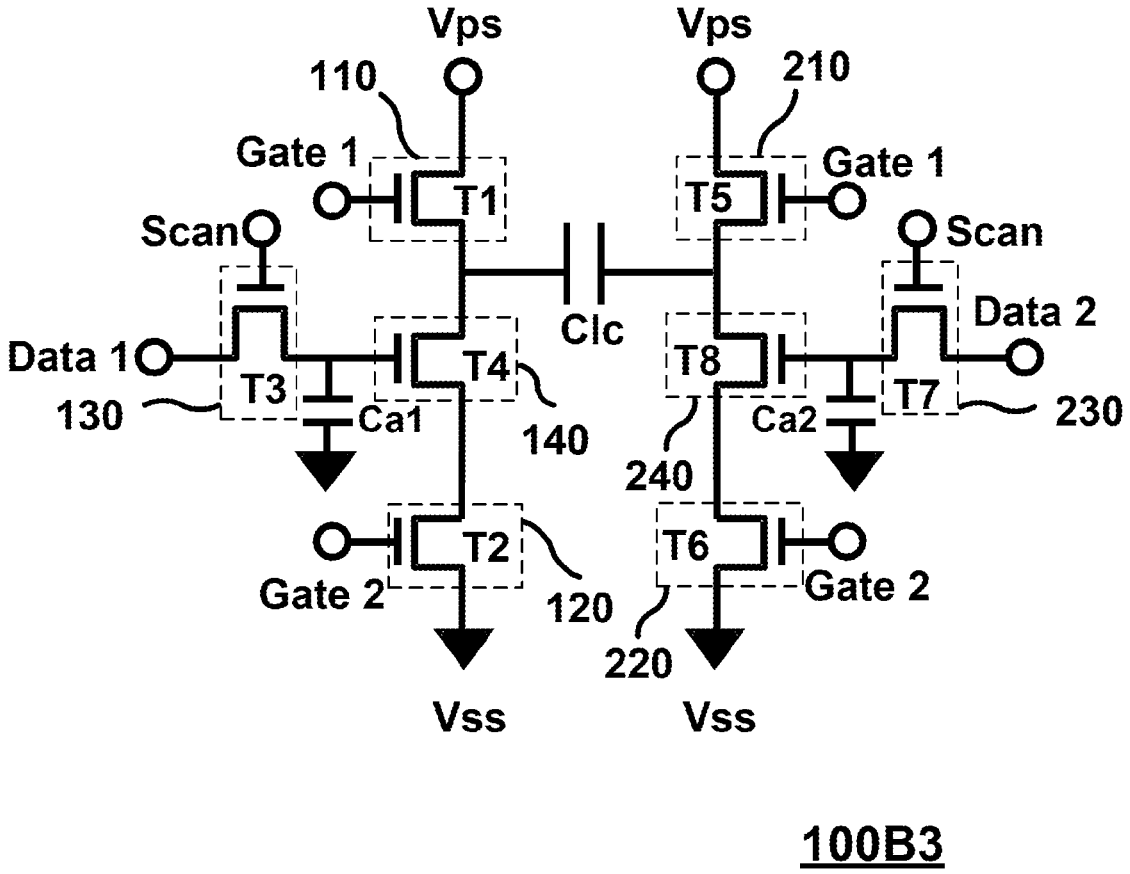
FIG. 10 depicts a schematic diagram of a pixel according to yet another embodiment of this invention.

FIG. 10 depicts a schematic diagram of a pixel according to yet another embodiment of this invention. As compared with the pixel 100A3 shown in FIG. 5A, the two terminals of the first adjusting unit 140 of a pixel 100B3 shown in FIG. 10 are electrically coupled to the first voltage dividing unit 110 and the first control unit 120, respectively. Two terminals of the second adjusting unit 240 of the pixel 100B3 are electrically coupled to the second voltage dividing unit 210 and the second control unit 220, respectively. In another embodiment, the second control unit 220 is configured to conduct the second adjusting unit 240 to the second voltage dividing unit 210 or conduct the first power voltage Vps to a ground terminal Vss based on the second control signal Gate 2. When implementing the present invention, the second voltage dividing unit 210, the second control unit 220, the second writing-in unit 230, and the second adjusting unit 240 can be respectively implemented by the fifth transistor T5, the sixth transistor T6, the seventh transistor T7, and the eighth transistor T8. The first terminal of the sixth transistor T6 is electrically coupled to the second terminal of the eighth transistor T8. The second terminal of the sixth transistor T6 is configured to receive the second power voltage Vss. The control terminal of the sixth transistor T6 is configured to receive the second control signal Gate 2.

Figure 11:
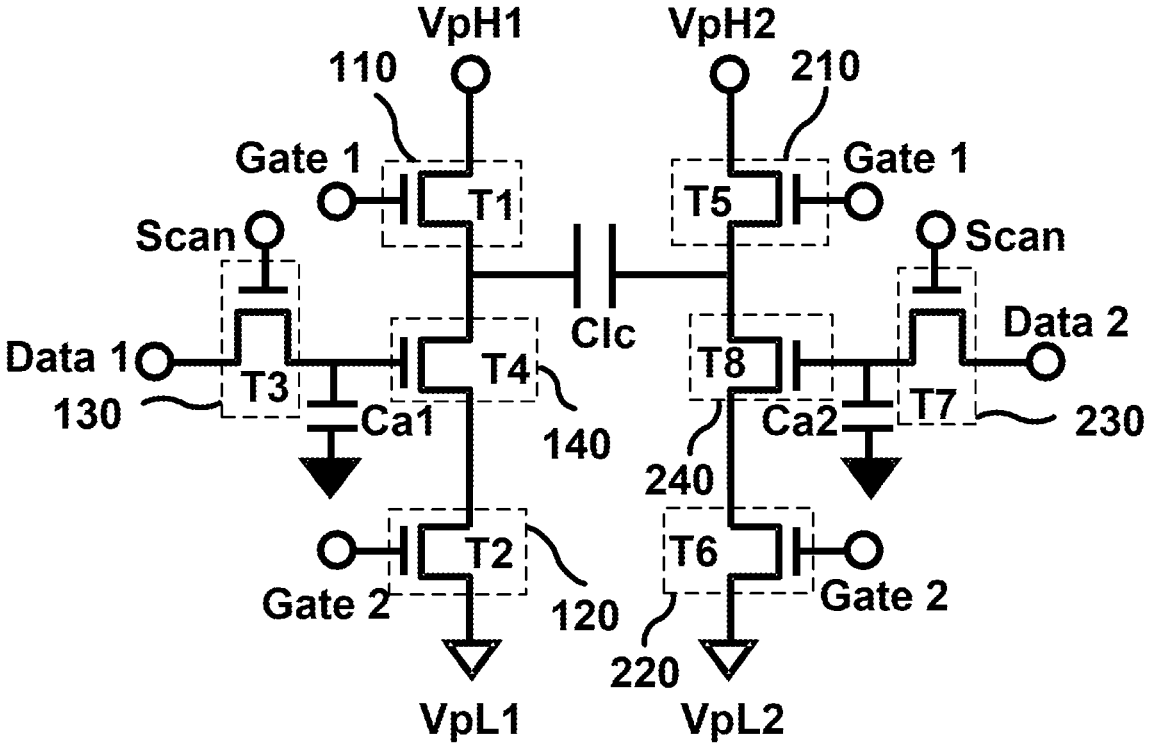
FIG. 11 depicts a schematic diagram of a pixel according to another embodiment of this invention.

FIG. 11 depicts a schematic diagram of a pixel according to another embodiment of this invention. As compared with the pixel 100A4 shown in FIG. 6A, the two terminals of the first adjusting unit 140 of a pixel 100B4 shown in FIG. 11 are electrically coupled to the first voltage dividing unit 110 and the first control unit 120, respectively. The two terminals of the second adjusting unit 240 of the pixel 100B4 are electrically coupled to the second voltage dividing unit 210 and the second control unit 220, respectively.

Figure 12:
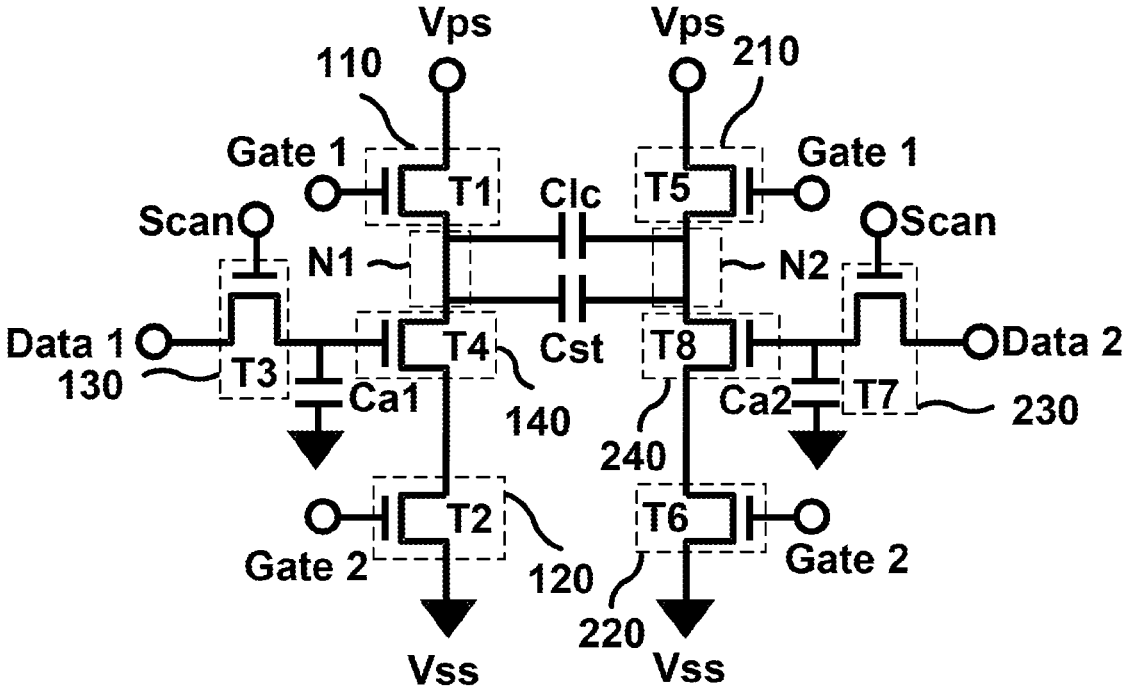
FIG. 12 depicts a schematic diagram of a pixel according to still another embodiment of this invention.

FIG. 12 depicts a schematic diagram of a pixel according to still another embodiment of this invention. As compared with the pixel 100A5 shown in FIG. 7, the two terminals of the first adjusting unit 140 of a pixel 100B5 shown in FIG. 12 are electrically coupled to the first voltage dividing unit 110 and the first control unit 120, respectively. The two terminals of the second adjusting unit 240 of the pixel 100B5 are electrically coupled to the second voltage dividing unit 210 and the second control unit 220, respectively.

Figure 13:
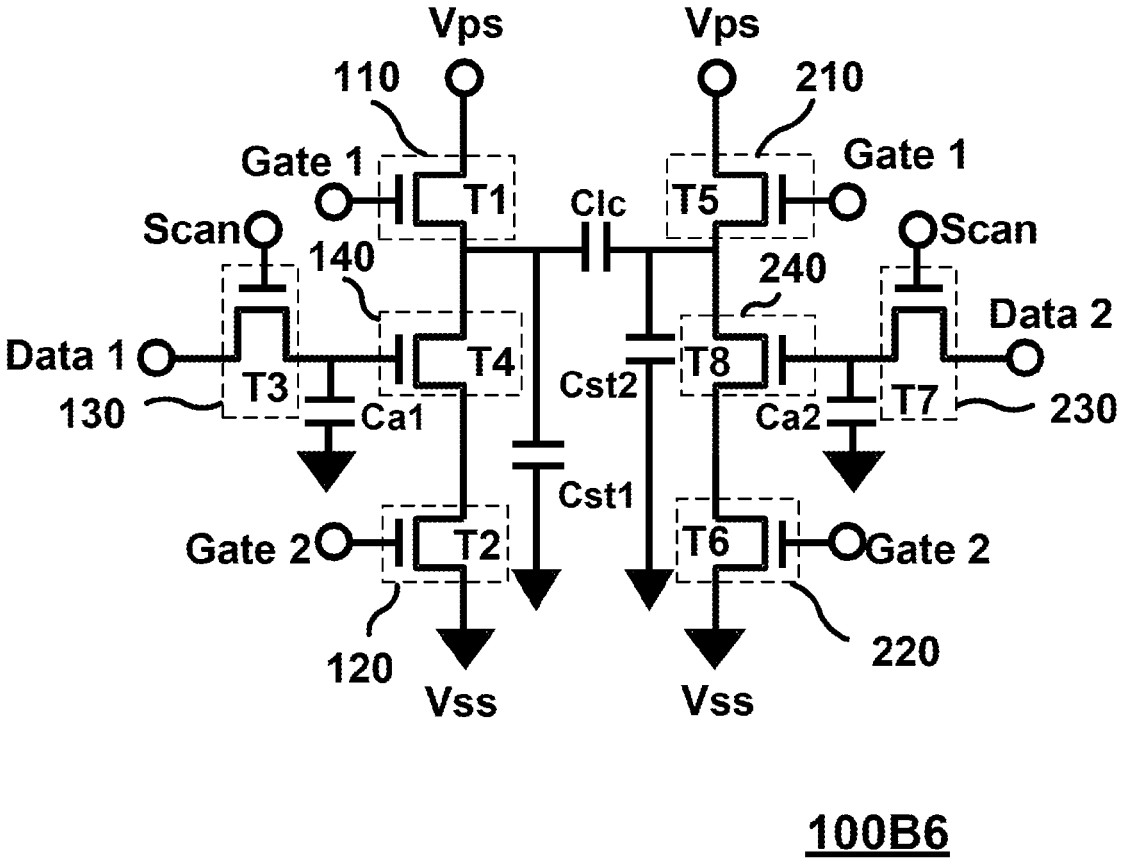
FIG. 13 depicts a schematic diagram of a pixel according to yet another embodiment of this invention.

FIG. 13 depicts a schematic diagram of a pixel according to yet another embodiment of this invention. As compared with the pixel 100A6 shown in FIG. 8, the two terminals of the first adjusting unit 140 of a pixel 100B6 shown in FIG. 13 are electrically coupled to the first voltage dividing unit 110 and the first control unit 120, respectively. The two terminals of the second adjusting unit 240 of the pixel 100B6 are electrically coupled to the second voltage dividing unit 210 and the second control unit 220, respectively.

Figure 14:
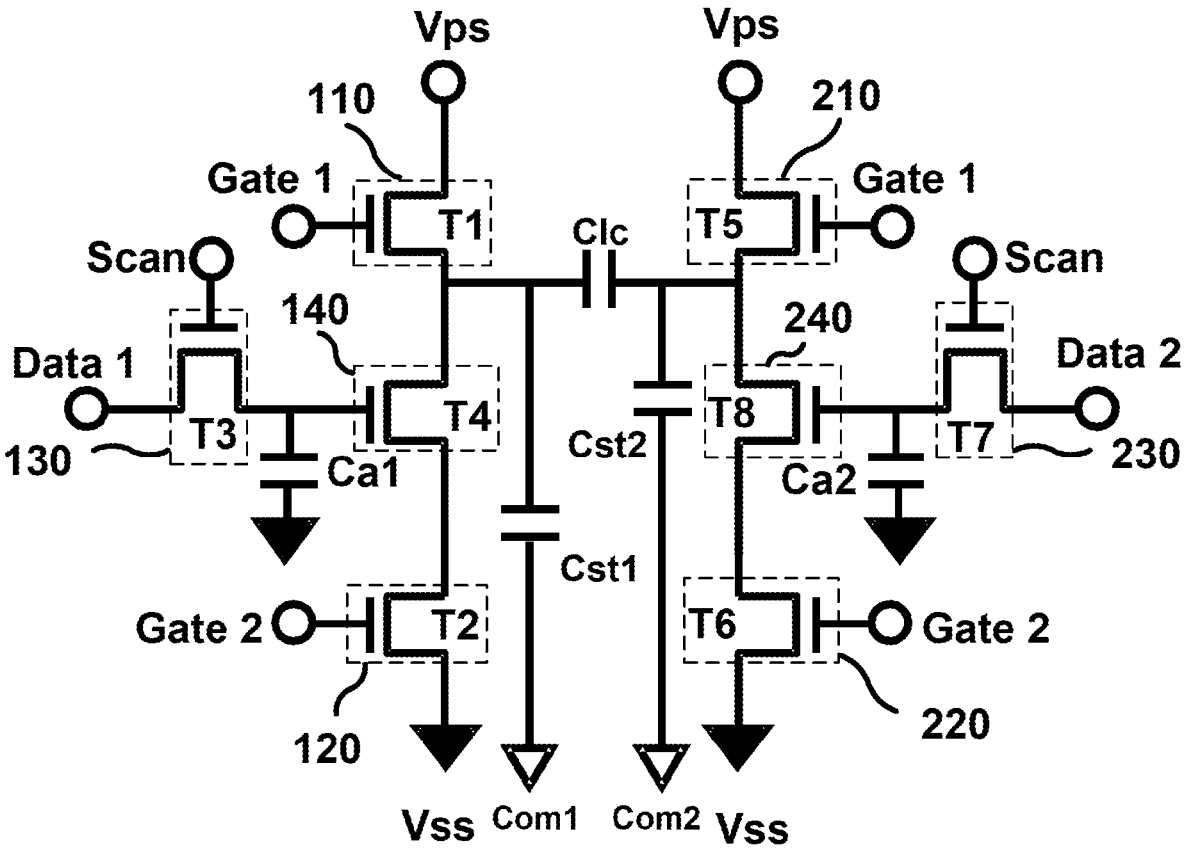
FIG. 14 depicts a schematic diagram of a pixel according to another embodiment of this invention.

FIG. 14 depicts a schematic diagram of a pixel according to another embodiment of this invention. As compared with the pixel 100A7 shown in FIG. 9A, the two terminals of the first adjusting unit 140 of a pixel 100B7 shown in FIG. 14 are electrically coupled to the first voltage dividing unit 110 and the first control unit 120, respectively. The two terminals of the second adjusting unit 240 of the pixel 100B7 are electrically coupled to the second voltage dividing unit 210 and the second control unit 220, respectively.

According to the embodiments, the embodiments of the present invention could provide a pixel to improve the problems of insufficient charges and reduced voltage and brightness caused by the decreased dielectric constant of LCs when the pixel is charged at a high frequency. In addition, after the charging process of the LC capacitor is completed, the pixel according to the embodiments of the present invention can turn off the circuit path to reduce the power loss.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A pixel comprising:

a first voltage dividing switch having a first terminal, a second terminal, and a control terminal, the first terminal of the first voltage dividing switch being configured to receive a first power voltage, the control terminal of the first voltage dividing switch being configured to receive a first control signal and determine whether to conduct the first terminal to the second terminal of the first voltage dividing switch based on the first control signal;

a liquid crystal capacitor electrically coupled to the second terminal of the first voltage dividing switch;

a first control switch electrically coupled to the first voltage dividing switch, the first control switch having a first terminal, a second terminal, and a control terminal, the control terminal of the first control switch being configured to receive a second control signal and determine whether to conduct the first terminal to the second terminal of the first control switch based on the second control signal;

a first capacitor;

a first writing-in switch electrically coupled to the first capacitor and configured to provide a first pixel data signal to the first capacitor based on a third control signal;

a first adjusting circuit electrically coupled to the first capacitor and configured to receive a second power voltage, and configured to, in cooperation with the first voltage dividing switch and the first control switch, divide a voltage difference between the first power voltage and the second power voltage based on the first pixel data signal stored in the first capacitor during a period when the first terminals and the second terminals of the first voltage dividing switch and the first control switch are conducted so as to control a voltage stored in the liquid crystal capacitor, such that a liquid crystal corresponding to the liquid crystal capacitor is controlled;

a second voltage dividing switch having a first terminal, a second terminal, and a control terminal, the first terminal of the second voltage dividing switch being configured to receive the first power voltage, the second terminal of the second voltage dividing switch being electrically coupled to the liquid crystal capacitor, the control terminal of the second voltage dividing switch being configured to receive the first control signal and determine whether to conduct the first terminal of the second voltage dividing switch to the second terminal of the second voltage dividing switch based on the first control signal;

a second control switch electrically coupled to the second voltage dividing switch, the second control switch having a first terminal, a second terminal, and a control terminal, the control terminal of the second control switch being configured to receive the second control signal and determine whether to conduct the first terminal of the second voltage dividing switch to the second terminal of the second control switch based on the second control signal;

a second capacitor;

a second writing-in switch electrically coupled to the second capacitor and configured to provide a second pixel data signal to the second capacitor based on the third control signal; and a second adjusting circuit electrically coupled to the second capacitor and configured to receive the second power voltage, and configured to, in cooperation with the second voltage dividing switch and the second control switch, divide a voltage difference between the first power voltage and the second power voltage based on the second pixel data signal stored in the second capacitor during a period when the first terminals and the second terminals of the second voltage dividing switch and the second control switch are conducted so as to control the voltage stored in the liquid crystal capacitor, such that the liquid crystal corresponding to the liquid crystal capacitor is controlled.

2. The pixel of claim 1, wherein the first control switch is configured to turn on or off a current path between the first voltage dividing switch and the second power voltage based on the second control signal.

3. The pixel of claim 2, wherein two terminals of the first control switch are electrically coupled to the first voltage dividing switch and the first adjusting circuit respectively.

4. The pixel of claim 1, wherein the second control switch is configured to turn on or off a current path between the second voltage dividing switch and the second power voltage based on the second control signal.

5. The pixel of claim 4, further comprising:

a first storage capacitor, wherein one terminal of the first storage capacitor is electrically coupled to a first terminal of the liquid crystal capacitor, another terminal of the first storage capacitor is electrically coupled to a second terminal of the first adjusting circuit; and a second storage capacitor, wherein one terminal of the second storage capacitor is electrically coupled to a second terminal of the liquid crystal capacitor, another terminal of the second storage capacitor is electrically coupled to a second terminal of the second adjusting circuit.

6. The pixel of claim 1, further comprising:

a first storage capacitor, wherein one terminal of the first storage capacitor is electrically coupled to a first terminal of the liquid crystal capacitor, another terminal of the first storage capacitor is electrically coupled to a second terminal of the first adjusting circuit; and a second storage capacitor, wherein one terminal of the second storage capacitor is electrically coupled to a second terminal of the liquid crystal capacitor, another terminal of the second storage capacitor is electrically coupled to a second terminal of the second adjusting circuit.

7. A pixel comprising:

a first transistor comprising:

a first terminal configured to receive a first power voltage;

a second terminal; and a control terminal configured to receive a first control signal and determine whether to conduct the first terminal to the second terminal of the first transistor based on the first control signal;

a liquid crystal capacitor comprising a first terminal and a second terminal, the first terminal of the liquid crystal capacitor being electrically coupled to the second terminal of the first transistor;

a second transistor comprising a first terminal, a second terminal, and a control terminal, the control terminal being configured to receive a second control signal and determine whether to conduct the first terminal to the second terminal of the second transistor based on the second control signal;

a first capacitor having a first terminal and a second terminal;

a third transistor comprising:

a first terminal configured to receive a first pixel data signal;

a second terminal electrically coupled to the first terminal of the first capacitor; and a control terminal configured to receive a third control signal and provide the first pixel data signal to the first capacitor based on the third control signal; a fourth transistor comprising:

a first terminal electrically coupled to the second terminal of the second transistor;

a second terminal configured to receive a second power voltage; and a control terminal electrically coupled to the first terminal of the first capacitor;

a fifth transistor comprising:

a first terminal configured to receive the first power voltage;

a second terminal electrically coupled to the liquid crystal capacitor; and a control terminal configured to receive the first control signal and determine whether to conduct the first terminal to the second terminal of the fifth transistor based on the first control signal;

a sixth transistor electrically coupled to the fifth transistor, the sixth transistor having a first terminal, a second terminal, and a control terminal, the control terminal being configured to receive the second control signal and determine whether to conduct the first terminal to the second terminal of the sixth transistor based on the second control signal;

a second capacitor comprising a first terminal and a second terminal;

a seventh transistor comprising:

a first terminal configured to receive a second pixel data signal;

a second terminal electrically coupled to the first terminal of the second capacitor; and a control terminal configured to receive the third control signal and provide the second pixel data signal to the third capacitor based on the third control signal; and an eighth transistor comprising:

a first terminal electrically coupled to the second terminal of the sixth transistor;

a second terminal configured to receive the second power voltage; and a control terminal electrically coupled to the first terminal of the second capacitor, and configured to divide a voltage difference between the first power voltage and the second power voltage based on the second pixel data signal stored in the second capacitor and in cooperation with the fifth transistor and the sixth transistor during the period when the first terminals and the second terminals of the fifth transistor and the sixth transistor are conducted so as to control the voltage stored in the liquid crystal capacitor, such that the liquid crystal corresponding to the liquid crystal capacitor is controlled.

8. The pixel of claim 7, wherein the first terminal of the second transistor is electrically coupled to the second terminal of the first transistor, the second terminal of the second transistor is electrically coupled to the first terminal of the fourth transistor, the control terminal of the second transistor is configured to receive the second control signal.

9. The pixel of claim 7, wherein the first terminal of the sixth transistor is electrically coupled to the second terminal of the fifth transistor, the second terminal of the sixth transistor is electrically coupled to the first terminal of the eighth transistor, the control terminal of the sixth transistor is configured to receive the second control signal.

10. The pixel of claim 9, further comprising:

a first storage capacitor, wherein one terminal of the first storage capacitor is electrically coupled to the first terminal of the liquid crystal capacitor, another terminal of the first storage capacitor is electrically coupled to the second terminal of the fourth transistor; and a second storage capacitor, wherein one terminal of the second storage capacitor is electrically coupled to the second terminal of the liquid crystal capacitor, another terminal of the second storage capacitor is electrically coupled to the second terminal of the eighth transistor.

11. The pixel of claim 7, further comprising:

a first storage capacitor, wherein one terminal of the first storage capacitor is electrically coupled to the first terminal of the liquid crystal capacitor, another terminal of the first storage capacitor is electrically coupled to the second terminal of the fourth transistor; and a second storage capacitor, wherein one terminal of the second storage capacitor is electrically coupled to the second terminal of the liquid crystal capacitor, another terminal of the second storage capacitor is electrically coupled to the second terminal of the eighth transistor.

* * * * *